US011362420B1

(12) United States Patent
Liu et al.

(10) Patent No.: US 11,362,420 B1
(45) Date of Patent: Jun. 14, 2022

(54) MINIATURIZED PRINTED ULTRA-WIDEBAND AND BLUETOOTH ANTENNA

(71) Applicant: Changsha Chixin Semiconductor Tech Co., Ltd., Hunan (CN)

(72) Inventors: Jianjun Liu, Hunan (CN); Zheyang Huang, Hunan (CN)

(73) Assignee: Changsha Chixin Semiconductor Tech Co., Ltd., Changsha (CN)

( * ) Notice: Subject to any disclaimer, the term of this patent is extended or adjusted under 35 U.S.C. 154(b) by 0 days.

(21) Appl. No.: 17/578,047

(22) Filed: Jan. 18, 2022

Related U.S. Application Data

(63) Continuation of application No. PCT/CN2021/138451, filed on Dec. 15, 2021.

(30) Foreign Application Priority Data

May 18, 2021 (CN) ..... 202110539526.7

(51) Int. Cl.
*H01Q 5/25* (2015.01)
*H01Q 9/42* (2006.01)
(Continued)

(52) U.S. Cl.
CPC ..... *H01Q 5/25* (2015.01); *H01Q 1/2291* (2013.01); *H01Q 1/38* (2013.01); *H01Q 9/045* (2013.01); *H01Q 9/0421* (2013.01); *H01Q 9/42* (2013.01)

(58) Field of Classification Search
CPC ..... H01Q 5/25; H01Q 1/2291; H01Q 9/0421; H01Q 9/045; H01Q 9/42; H01Q 1/38
See application file for complete search history.

(56) References Cited

U.S. PATENT DOCUMENTS 8,754,817 B1 6/2014 Kuo et al.
8,963,780 B2 * 2/2015 Hsu ..... H01Q 1/243 343/702
(Continued)

FOREIGN PATENT DOCUMENTS

CN 201319403 Y 9/2009
CN 102509875 A 6/2012
(Continued)

OTHER PUBLICATIONS

International Search Report and Written Opinion for International Application No. PCT/CN2021/138451, dated Mar. 2, 2022, with partial translation, 15 pages.

*Primary Examiner* — Dimary S Lopez Cruz
*Assistant Examiner* — Michael M Bouizza
(74) *Attorney, Agent, or Firm* — RatnerPrestia

(57) ABSTRACT

The present invention provides a printed miniaturized ultra-wideband (UWB) and Bluetooth antenna, comprising a dielectric substrate, a printed monopole antenna plate, a metal ground and a metal microstrip feed, wherein the printed monopole antenna plate is arranged on the front side of the dielectric substrate; the printed monopole antenna plate comprises first and second antenna elements configured to operate in the ultra wideband communication band
(Continued)

and operate in the Bluetooth communication band respectively, and the first antenna and second antenna elements share the common metal ground and the metal microstrip feed; the first antenna element has a rectangular shape with rounded and smoothed corners; the right side of the first antenna element comprises a first antenna body, and a rectangular notch is etched from the left side of the first antenna element; the left side of the second antenna element comprises a second antenna body, and the right side of the second antenna element has a plurality of bent portions; and the plurality of bent portions are arranged inside of the rectangular notch of the first antenna element. The antenna provided by the present invention is miniaturized, so that an antenna with a compact structure is achieved which can cover two wireless standard frequency bands.

9 Claims, 8 Drawing Sheets

(51) Int. Cl.

| | |
|---|---|
| ***H01Q 1/22*** | (2006.01) |
| ***H01Q 1/38*** | (2006.01) |
| ***H01Q 9/04*** | (2006.01) |

(56) References Cited

U.S. PATENT DOCUMENTS

| | | | | |
|---|---|---|---|---|
| 2004/0108957 | A1* | 6/2004 | Umehara | H01Q 1/38 343/702 |
| 2007/0046548 | A1* | 3/2007 | Pros | H01Q 9/42 343/702 |
| 2008/0180333 | A1* | 7/2008 | Martiskainen | H01Q 9/42 343/722 |
| 2009/0135087 | A1* | 5/2009 | Gummalla | H01Q 15/0086 343/909 |
| 2012/0146853 | A1* | 6/2012 | Chang | H01Q 9/42 343/700 MS |
| 2014/0049431 | A1* | 2/2014 | Tai | H01Q 9/42 343/700 MS |

FOREIGN PATENT DOCUMENTS

| | | | | |
|---|---|---|---|---|
| CN | 102780081 | A | | 11/2012 |
| CN | 202977717 | U | * | 6/2013 |
| CN | 113300099 | A | | 8/2021 |
| JP | 2006054639 | A | | 2/2006 |

* cited by examiner

MINIATURIZED PRINTED ULTRA-WIDEBAND AND BLUETOOTH ANTENNA

CROSS-REFERENCE TO RELATED APPLICATIONS

This application is a U.S. Continuation Application which claims priority from PCT/CN2021/138451, filed Dec. 15, 2021, which claims priority from CN 202110539526.7, filed May 18, 2021, incorporated herein by reference in its entirety.

TECHNICAL FIELD

Embodiments of the present invention relate to the field of printed antennas, and more particularly to a miniaturized printed ultra-wideband and Bluetooth antenna.

BACKGROUND ART

Ultra-Wideband (UWB) is suitable for a wide range of wireless systems, and UWB can be traced back to telegraph systems including the transatlantic pulse signal transmission noted in 1901. The technology then finds some applications in radar, mainly for military purposes. In 2002, the U.S. Communications Commission adopted the regulations that the frequency band of 3.1-10.6 GHz was classified as commercial use and the frequency band of 22-29 GHz was classified as on-board radar system. Since then, UWB technology has broken through the application limitations only in radar and military communications in the past decades. In the next few years, UWB technology has become a competitive solution for short-range high-speed wireless systems due to its simple transmit-receive structure, low power consumption and high transmission rate, and various related applications have been widely studied. Since 2019, some well-known companies and agencies such as Apple and Car Connectivity Consortium (CCC) have issued new products including iPhone 11 series, containing Ultra Wide Band (UWB) technology which has received further extensive attention from the scientific and media community. The FIRA Alliance for promoting UWB industry and technology was launched in August 2019. In addition, a white paper related to UWB systems was presented in October 2020. Currently, the development of UWB has been boosted by multiple assistance from markets and standards-making organizations, and UWB technology has achieved access to multiple mass wireless intelligent devices, such as Apple, MIUI, Samsung products, etc.

Bluetooth is a wireless communication technology standard developed by the telecom supplier Ericsson in 1994. Bluetooth is used to enable fixed and mobile devices to exchange data over short distances to form a personal area network (PAN). Communication takes place via the ISM band of 2.4 to 2.485 GHz. Bluetooth technology is currently under the responsibility of the Bluetooth Alliance to maintain its technical standards, distributed in the fields of telecommunications, computers, networks and consumer electronics. Bluetooth is a radio technology that supports short-range communication of devices, enabling wireless information exchange among many devices, including mobile phones, wireless headsets, laptops, related peripherals, etc. As a short-range wireless connection technology, Bluetooth can achieve convenient, flexible, secure, low-cost, low-power communication and voice communication among devices. Therefore, it is one of the mainstream technologies to achieve wireless personal area network communication. As an emerging short-range wireless communication technology, Bluetooth is vigorously promoting low-rate wireless personal area networks.

With the rapid development of mobile communication and Internet of Things, wireless systems with different frequency bands and standards are often integrated into one mobile device, including a Bluetooth system and an ultra wideband system. This also places higher demands on the antennas of mobile devices and wireless systems, such as small size, simple structure, easy integration with circuitry, etc. Antenna is one of the most important radio frequency units in wireless systems. The performance of antenna in different standard frequency bands directly determines the overall performance of the system. Generally, in order to meet the requirements of multiple frequency bands in a system, a plurality of antennas are installed in the system, each antenna being used to cover a single frequency band. However, the plurality of antennas take up a lot of space and increase the complexity of the system. In addition, the installation of a plurality of antennas also affects the timely upgrade of the system.

Accordingly, there is a need to provide a single antenna having a bandwidth that can cover both the ultra wideband and the Bluetooth frequency band, the antenna being compact and easy to synthesize with current integrated circuits.

SUMMARY OF THE INVENTION

The present invention provides a miniaturized printed ultra wideband and Bluetooth antenna, wherein the spatial combination of two antennas is optimized by improving the miniaturization of a Bluetooth antenna and an ultra wideband antenna, so that the antenna with a compact structure is achieved which can cover two wireless standard frequency bands.

Embodiments of the present invention provide a miniaturized printed ultra wideband and Bluetooth antenna, comprising a dielectric substrate, a printed monopole antenna plate, a metal ground, and a metal microstrip feed, wherein the printed monopole antenna plate is arranged on a front side of the dielectric substrate;

the printed monopole antenna plate comprises a first antenna element configured to operate in an ultra wideband communication band and a second antenna element configured to operate in a Bluetooth communication band, the first antenna element and the second antenna element sharing the metal ground and the metal microstrip feed;

the first antenna element has a rectangular shape with rounded and smoothed corners; the right side of the first antenna element comprises a first antenna body, and a rectangular notch is etched from the left side of the first antenna element; the left side of the second antenna element comprises a second antenna body, and the right side of the second antenna element has a plurality of bent portions arranged inside of the rectangular notch of the first antenna element; and the sum of the lengths of the plurality of bent portions is 0.2-0.4 times the wavelength of the center frequency of Bluetooth standard.

Optionally, the plurality of bent portions comprise a first bent subsection, a second bent subsection, a third bent subsection and a fourth bent subsection connected end to end, wherein the first bent subsection and the fourth bent subsection are parallel to each other and distributed transversely; the second bent subsection and the third bent subsection are parallel to each other and longitudinally distributed; and the first bent subsection is longer than the fourth bent subsection, and the second bent subsection is longer than the third bent subsection.

Optionally, the first bent subsection has a length of 6.25 mm and a width of 1.4 mm; the second bent subsection has a length of 14 mm and a width of 1.4 mm; the third bent subsection has a length of 12 mm and a width of 1.4 mm; and the fourth bent subsection has a length of 4 mm and a width of 1.4 mm.

Optionally, the printed monopole antenna plate has a rectangular shape with rounded and smoothed corners after asymmetrical miniaturization from a symmetrical circular or square radiating patch; and the rectangular notch is etched on the left side of the first antenna element.

Optionally, the metal ground is arranged on the back side of the dielectric substrate; the metal ground is in the shape of a right-angled trapezoid; the width of the metal ground is 0.1-0.3 times a longest operating wavelength; the height of the metal ground is 0.1-1 times the width of the metal ground; and the sum of the height of the metal ground and the height of the first antenna element is 0.4-0.6 times the longest operating wavelength;

the top width of the metal ground is 0.2-0.8 times the bottom width of the metal ground; and the projected distance of the printed monopole antenna plate from the metal ground is 0.04-0.2 times the bottom width of the metal ground.

Optionally, the metal microstrip feed is arranged on the back side of the dielectric substrate, the metal microstrip feed being tapered from bottom to top to achieve impedance transformation.

Optionally, a first gap is formed between the second bent subsection and the third bent subsection, the first gap having a width of 1.2 mm; a second gap is formed between the third bent subsection and the second antenna body, the second gap having a width of 1 mm; a third gap is formed between the first bent subsection and the fourth bent subsection, the third gap having a width of 11.2 mm; and a fourth gap is formed between the fourth bent subsection and the first antenna body, the fourth gap having a width of 1.5 mm.

Optionally, a first end of the first antenna element is electrically connected to a feeding end of the metal microstrip feed, and a second end of the first antenna element is a free end suitable for radiating a signal; and a first end of the second antenna element is electrically connected to a feeding end of the metal microstrip feed, and a second end of the second antenna element is a free end suitable for radiating a signal.

Optionally, right upper and lower ends of the printed monopole antenna plate are rounded and smoothed respectively.

Optionally, the dielectric substrate has a dielectric constant of 2-10, a loss tangent of $10^{-3}$ or less, and a thickness of 3 mm or less.

Compared to the prior art, the technical solutions of embodiments of the present invention have the following advantageous effects.

A miniaturized printed ultra wideband and Bluetooth antenna of an embodiment of the present invention comprises a first antenna element and a second antenna element, wherein the first antenna element has a rectangular shape with rounded and smoothed corners; the right side of the first antenna element comprises a first antenna body, and a rectangular notch is etched from the left side of the first antenna element; the left side of the second antenna element comprises a second antenna body, and the right side of the second antenna element has a plurality of bent portions arranged inside of the rectangular notch of the first antenna element. Since the plurality of bent portions of the second antenna element can be arranged inside of the rectangular notch of the first antenna element, the area of the antenna is greatly reduced, and the process design requirements for miniaturization of today's mobile terminals can still be met by covering both ultra wideband and Bluetooth wireless standard frequency bands.

Furthermore, the first antenna element has a rectangular shape with rounded and smoothed corners after asymmetrical miniaturization from a symmetrical circular or square radiating patch; and the rectangular notch is etched on the left side of the first antenna element; the structure is simple, and it is easy to implement the the process; and it is easy to be integrated with a circuit.

Further, the metal ground is arranged on the back side of the dielectric substrate; the metal ground is in the shape of a right-angled trapezoid; the printed monopole antenna plate is arranged on the front side of the dielectric substrate; and the metal ground and the printed monopole antenna are respectively arranged on the back side and the front side of the dielectric substrate, thereby better realizing an ultra wideband characteristic.

Further, the metal microstrip feed is arranged on the back side of the dielectric substrate, and the microstrip feeder is tapered from bottom to top to achieve impedance matching of the bottom and top antenna radiating patches of the microstrip feeder.

Further, the lower right-side end of the first antenna body is rounded and smoothed, thereby optimizing impedance matching and relaxing tolerances of antenna processing.

Further, the miniaturized printed ultra wideband and Bluetooth antenna of embodiments of the present invention has a width of only 1.75 cm and a printed planar area of only 5.75 $cm^2$, with a compact structure. After performance tests, it has been shown to operate at the 2.33-2.54 GHz and 3.09-11 GHz bands and may cover both Bluetooth (2.4-5.485 GHz) and ultra wideband (3.1-10.6 GHz) communication bands.

BRIEF DESCRIPTION OF THE DRAWINGS

In order to more clearly describe the technical solutions in the embodiments of the invention or prior art, the following will briefly introduce the drawings to be used in the description of the embodiments or the prior art. It will be apparent to those skilled in the art that the drawings in the following description are only some embodiments, not all, of the invention. For a person of ordinary skill in the art, other drawings may be obtained from the drawings without involving any inventive effort.

DETAILED DESCRIPTION OF THE INVENTION

In order to make the objectives, technical solutions, and advantages of embodiments of the invention clearer, the technical solutions in the embodiments of the invention will be described clearly and completely in conjunction with the accompanying drawings in the embodiments of the invention. Obviously, the described embodiments are part of the invention, rather than all of the embodiments. Based on the embodiments in the invention, all other embodiments obtained by a person skilled in the art without involving any inventive effort are within the scope of protection of the invention.

Hereinafter, embodiments of the present invention will be described in detail with reference to specific embodiments. The following specific embodiments may be combined with one another, and the same or similar concepts or processes may not be repeated in some embodiments.

Based on the problems existing in the prior art, the embodiments of the present invention provide a miniaturized printed ultra wideband and Bluetooth antenna, wherein the spatial combination of two antennas is optimized by improving the miniaturization of a Bluetooth antenna and an ultra wideband antenna, so that the antenna with a compact structure is achieved which can cover two wireless standard frequency bands.

Figure 1:
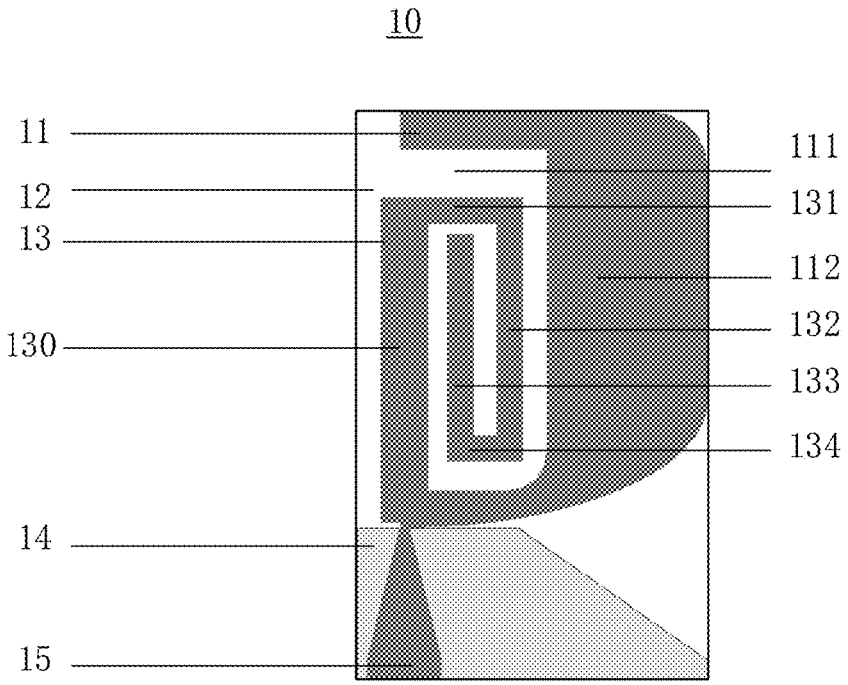
FIG. 1 is a block diagram of a miniaturized printed ultra wideband and Bluetooth antenna 10 according to an embodiment of the present invention.

FIG. 1 is a structurally schematic diagram of a miniaturized ultra wideband and Bluetooth printed antenna 10 according to an embodiment of the present invention. An embodiment of the present invention provides a miniaturized printed ultra wideband and Bluetooth antenna, comprising a dielectric substrate 12, a printed monopole antenna plate disposed on a front side of the dielectric substrate 12, a metal ground 14 and a metal microstrip feed 15, wherein the printed monopole antenna plate is arranged on the front side of the dielectric substrate 12; the printed monopole antenna plate comprises a first antenna element 11 configured to operate in an ultra wideband communication band and a second antenna element 13 configured to operate in a Bluetooth communication band, and the first antenna element 11 and the second antenna element 13 share the metal ground 14 and the metal microstrip feed 15; the first antenna element 11 has a rectangular shape with rounded and smoothed corners; the right side of the first antenna element 11 comprises a first antenna body 112, and the left side of the first antenna element 11 comprises a rectangular notch 111; the left side of the second antenna element 13 comprises a second antenna body 130, and the right side of the second antenna element 13 has a plurality of bent portions arranged in the rectangular notch 111 of the first antenna element 11; and the sum of the lengths of the plurality of bent portions is 0.2-0.4 times the wavelength of the center frequency of Bluetooth standard.

Since multiple bendings will affect the current effectively flowing into the end of the branch, the bending portion at the end has little effect on the performance of the antenna working in the Bluetooth frequency band. Therefore, the sum of the lengths of the plurality of bent portions increases in adjustability as the number of bends increases.

In a particular implementation, the plurality of bent portions comprise a first bent subsection 131, a second bent subsection 132, a third bent subsection 133 and a fourth bent subsection 134 connected end to end, wherein the first bent subsection 131 and the fourth bent subsection 134 are parallel to each other and distributed transversely; the second bent subsection 132 and the third bent subsection 133 are parallel to each other and distributed longitudinally; and the first bent subsection 131 is longer than the fourth bent subsection 134, and the second bent subsection 132 is longer than the third bent subsection 133.

In some embodiments, the printed monopole antenna plate and the metal ground 14 are almost halved in symmetry while maintaining antenna broadband matching. In order to avoid the additional space occupied by the Bluetooth antenna, the upper left side of the reduced printed monopole antenna plate is further truncated by a portion of the rectangle, leaving a rectangular notch 111 for placement of a Bluetooth antenna. The Bluetooth antenna is an antenna in the form of a narrow band, placed in a rectangular notch 111.

In some embodiments, the printed monopole antenna plate is an etched printed defect type rectangular shape with rounded and smoothed corners and a bent matrix structure. Specifically, the first antenna element 11 is an etched printed defect type rectangular shape with rounded and smoothed corners; and the second antenna element 12 is a bent matrix structure.

In some embodiments, the first bent subsection 131 has a length of 6.25 mm and a width of 1.4 mm; the second bent subsection 132 has a length of 14 mm and a width of 1.4 mm; the third bent subsection 133 has a length of 12 mm and a width of 1.4 mm; and the fourth bent subsection 134 has a length of 4 mm and a width of 1.4 mm to reach frequencies operating in the Bluetooth band.

The length and width of the plurality of bent portions and the sum of the lengths can seriously affect the bandwidth and center frequency of the antenna. The plurality of bent portions are derived from a printed monopole antenna plate; the length of the printed monopole antenna plate determines the center frequency of the Bluetooth antenna; and the center frequency of the Bluetooth frequency band is determined by the total length of the plurality of bent portions added together. The width of the plurality of bent portions affect the bandwidth of the Bluetooth frequency band and the matching characteristics in the band. Therefore, a minimum frequency of the antenna can be reduced by increasing the length and width of the plurality of bent portions, i. e. the operating center frequency of the Bluetooth antenna can be ensured by increasing the size of the antenna. Widening the width of plurality of bent portions can lead more current to the bent branches, which can effectively improve the matching characteristics in the Bluetooth band and reduce the return loss in the antenna band. With comprehensive consideration of the space reserved for the Bluetooth antenna, on the one hand, the width of plurality of bent portions cannot be too thin, ensuring that sufficient current is fed into the Bluetooth antenna; on the other hand, the distance between the plurality of bent portions and the volume of the plurality of bent portions themselves cannot be too large, so as to realize the miniaturization of the Bluetooth antenna portion.

In some embodiments, the printed monopole antenna plate has a rectangular shape with rounded and smoothed corners after asymmetrical miniaturization from a symmetrical circular or square radiating patch; and the rectangular notch 111 is etched on the left side of the first antenna element 11.

Since a lowest frequency of the ultra wideband antenna is determined by the sum of the effective current paths of the antenna, the lowest operating frequency of the antenna is reduced by increasing either the height or the width of the printed monopole antenna plate. The shape configuration of the printed monopole antenna plate and the metal ground 14 affects the impedance matching at the low frequency band of the ultra wideband antenna.

In some embodiments, the metal ground 14 is arranged on the back side of the dielectric substrate 12; the metal ground 14 is in the shape of a right-angled trapezoid; the upper bottom edge of the metal ground 14 are rounded and printed on the back side of the dielectric substrate 12; and the metal ground 14 is not higher than the length of the metal microstrip feed 15. The metal ground 14 has a width after miniaturization, which is half the width of the ground of the printed ultra wideband antenna with a generally symmetrical structure; the width of the metal ground 14 is 0.1-0.3 times the longest operating wavelength; the height of the metal ground 14 is 0.1-1 times the width of the metal ground; the sum of the height of the metal ground 14 and the height of the first antenna element 11 is 0.4-0.6 times the longest operating wavelength; the top width of the metal ground 14 is 0.2-0.8 times the bottom width of the metal ground 14; and the projected distance of the printed monopole antenna plate from the metal ground 14 is 0.04-0.2 times the bottom width of the metal ground 14. The width of the upper base of the metal ground 14 and the projected distance between the printed single antenna plate and the metal ground 14 have a decisive effect on the impedance matching of the high-frequency part of the antenna; and a reasonable design of the width of the upper base of the trapezoidal ground and a suitable selection of the projected distance between the rectangular patch with rounded and smoothed corners and the trapezoidal ground can effectively increase the maximum working efficiency of the antenna.

In some embodiments, the metal microstrip feed 15 is arranged on the back side of the dielectric substrate 12, and the metal microstrip feed 15 is tapered from bottom to top to achieve impedance transformation; and the characteristic impedance of the input end of the metal microstrip feed 15 is 50 ohms, and the lower end of the metal microstrip feed 15 is connected to the inner conductor of the coaxial joint.

In some embodiments, a first gap is formed between the second bent subsection 132 and the third bent subsection 133, the first gap having a width of 1.2 mm; a second gap is formed between the third bent subsection 133 and the second antenna body 130, the second gap having a width of 1 mm; a third gap is formed between the first bent subsection 131 and the fourth bent subsection 133, third gap having a width of 11.2 mm; and a fourth gap is formed between the fourth bent subsection 134 and the first antenna body 112, the fourth gap having a width of 1.5 mm.

In some embodiments, a first end of the first antenna element 11 is electrically connected to a feeding end of the metal microstrip feed 15, and a second end of the first antenna element 11 is a free end suitable for radiating a signal; and a first end of the second antenna element 13 is electrically connected to a feeding end of the metal microstrip feed 15, and a second end of the second antenna element 13 is a free end suitable for radiating a signal.

In some embodiments, the upper and lower ends of the right side of the printed monopole antenna plate are rounded and smoothed, respectively; and the printed monopole antenna plate may be a quadrate, square, circular, elliptical, or rectangular ring-shaped patch.

In some embodiments, the dielectric substrate 12 has a dielectric constant of 2-10, a loss tangent of $10^{-3}$ or less, and a thickness of 3 mm or less.

Figure 2:
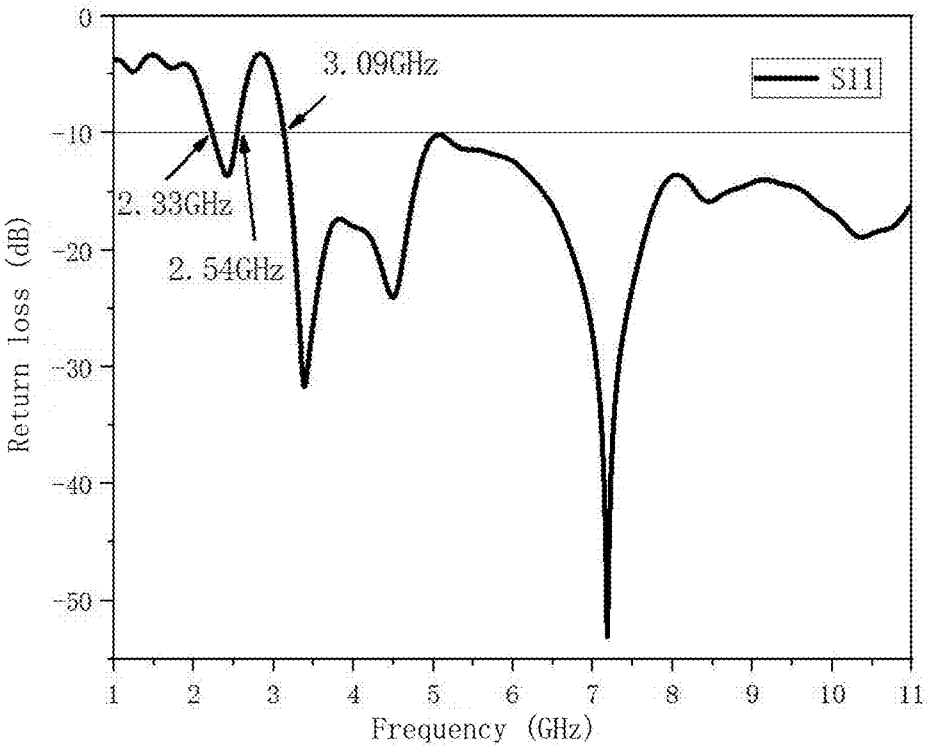
FIG. 2 is a curve graph of return loss for a miniaturized printed ultra wideband and Bluetooth antenna according to an embodiment of the present invention.

Referring to FIGS. 2-10 in combination, FIG. 2 is a curve graph of return loss for a miniaturized printed ultra wideband and Bluetooth antenna according to an embodiment of the present invention. The ordinate of FIG. 2 is return loss/dB, and the abscissa is frequency/GHz. It can be seen from FIG. 2 that the miniaturized printed ultra wideband and Bluetooth antenna in the present embodiment can work in the frequency bands of 2.33-2.54 GHz and 3.09-11 GHz, wherein the return loss of the Bluetooth frequency band (2.4-2.485 GHz) is less than −10 dB, and the return loss of the ultra wideband (3.1-10.6 GHz) frequency band is less than −10 dB; and two wireless standard frequency bands of ultra wideband and Bluetooth can be covered.

Figure 3:
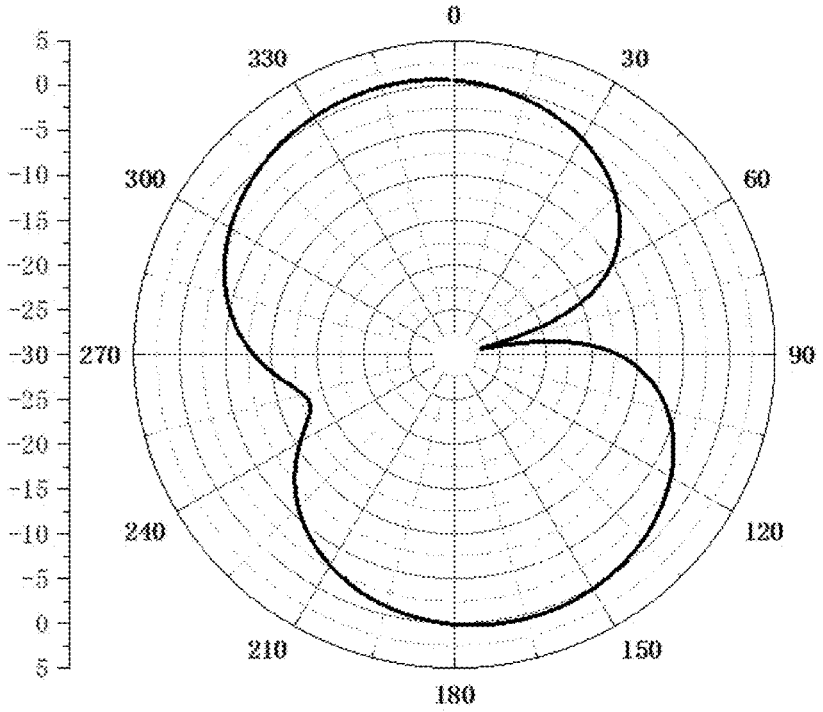
FIG. 3 is a schematic diagram of a miniaturized printed ultra wideband and Bluetooth antenna in the E-plane radiation direction at the 2.45 GHz frequency point according to an embodiment of the present invention.
Figure 4:
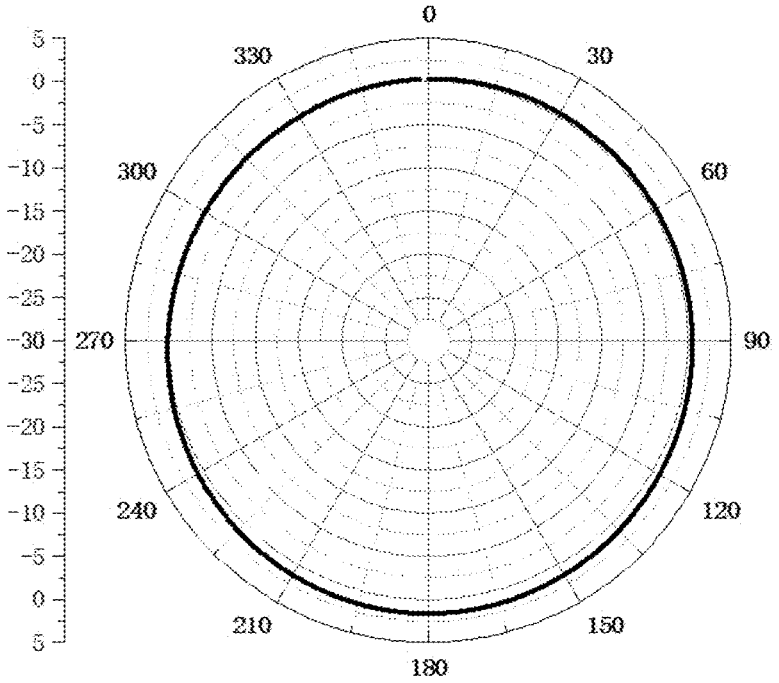
FIG. 4 is a schematic diagram of a miniaturized printed ultra wideband and Bluetooth antenna in the H-plane radiation direction at the 2.45 GHz frequency point according to an embodiment of the present invention.

FIGS. 3 and 4 are schematic diagrams of a miniaturized printed ultra wideband and Bluetooth antenna in the E-plane and H-plane radiation directions at the 2.45 GHz frequency point according to an embodiment of the present invention. It can be seen from the radiation pattern at the frequency point of 2.45 GHz in the center frequency of the Bluetooth frequency band that the miniaturized printed ultra wideband and Bluetooth antennas achieve a relatively obvious monopole radiation characteristic at the Bluetooth frequency band.

Figure 5:
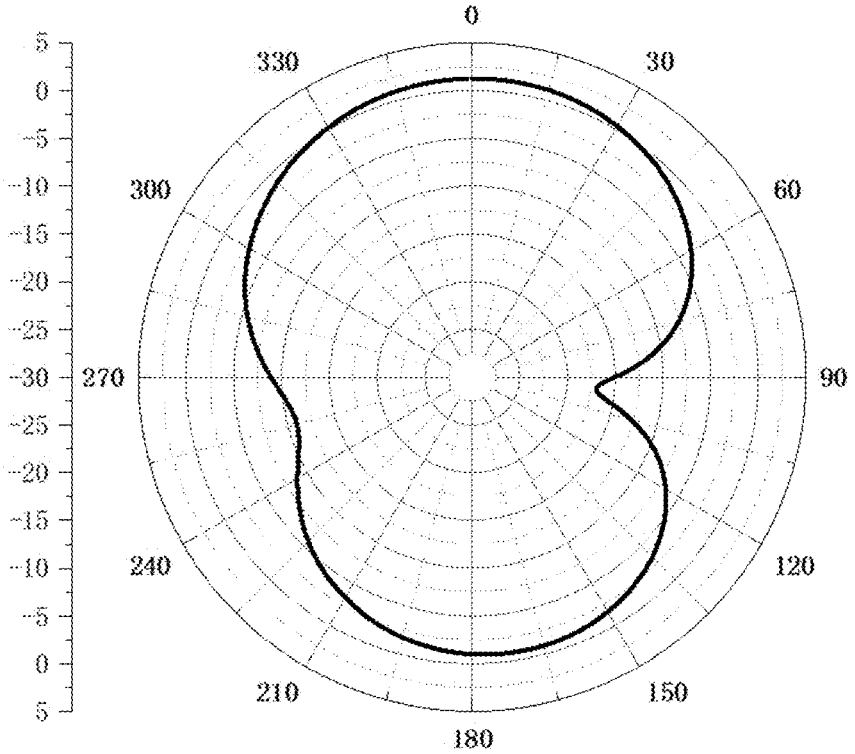
FIG. 5 is a schematic diagram of a miniaturized printed ultra wideband and Bluetooth antenna in the E-plane radiation direction at the 3.5 GHz frequency point according to an embodiment of the present invention.
Figure 6:
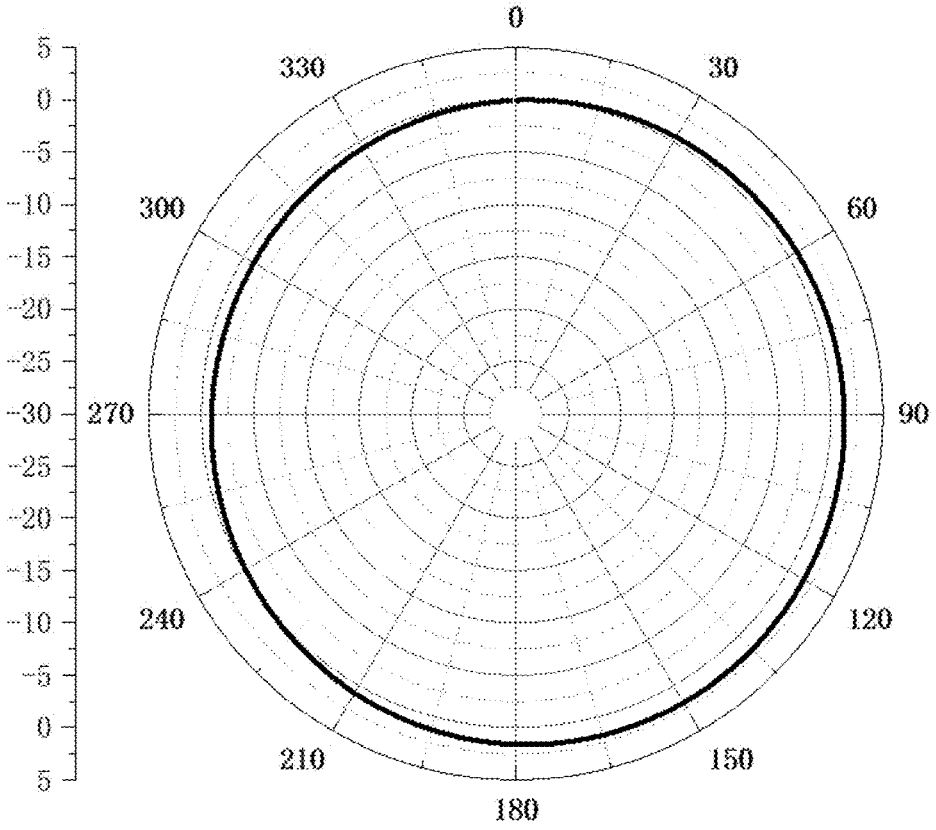
FIG. 6 is a schematic diagram of a miniaturized printed ultra wideband and Bluetooth antenna in the H-plane radiation direction at the 3.5 GHz frequency point according to an embodiment of the present invention.
Figure 7:
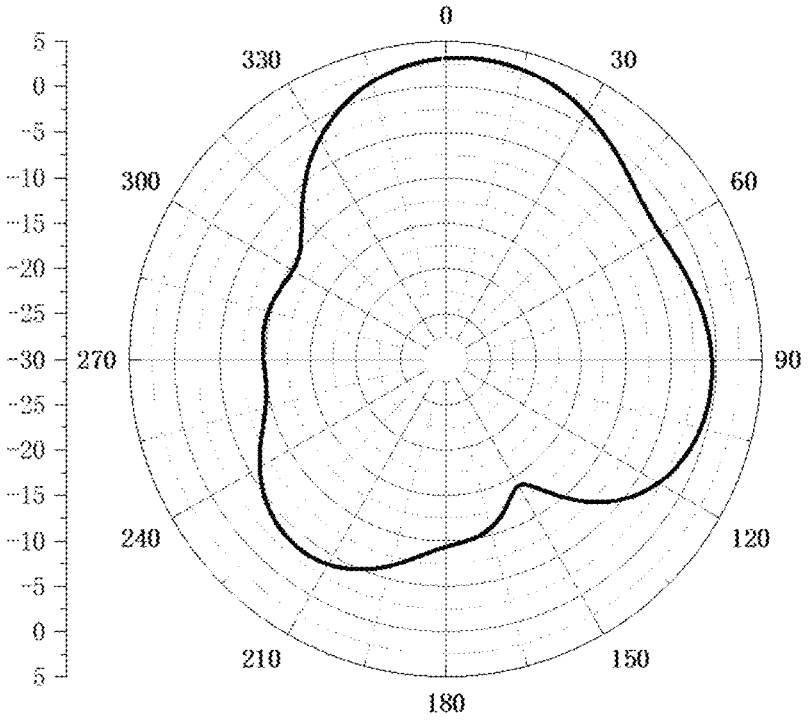
FIG. 7 is a schematic diagram of a miniaturized printed ultra wideband and Bluetooth antenna in the E-plane radiation direction at the 7.0 GHz frequency point according to an embodiment of the present invention.
Figure 8:
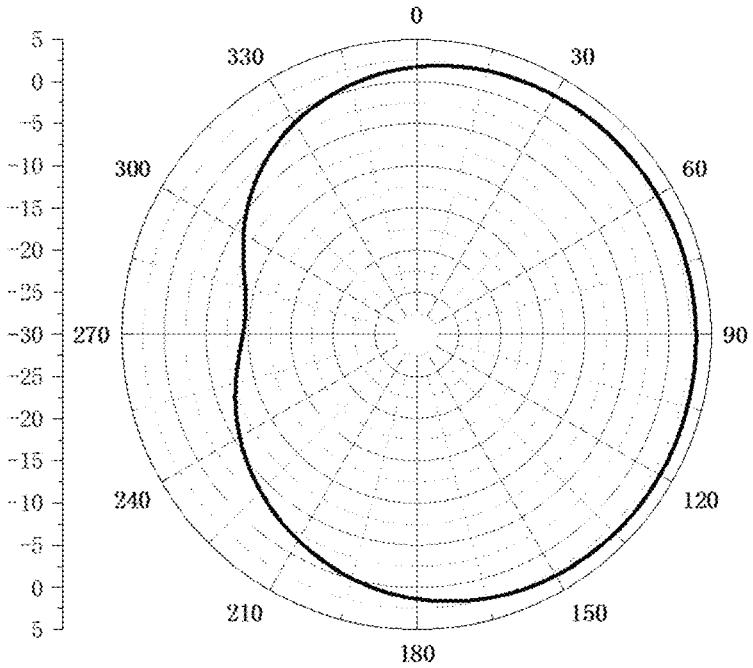
FIG. 8 is a schematic diagram of a miniaturized printed ultra wideband and Bluetooth antenna in the H-plane radiation direction at the 7.0 GHz frequency point according to an embodiment of the present invention.
Figure 9:
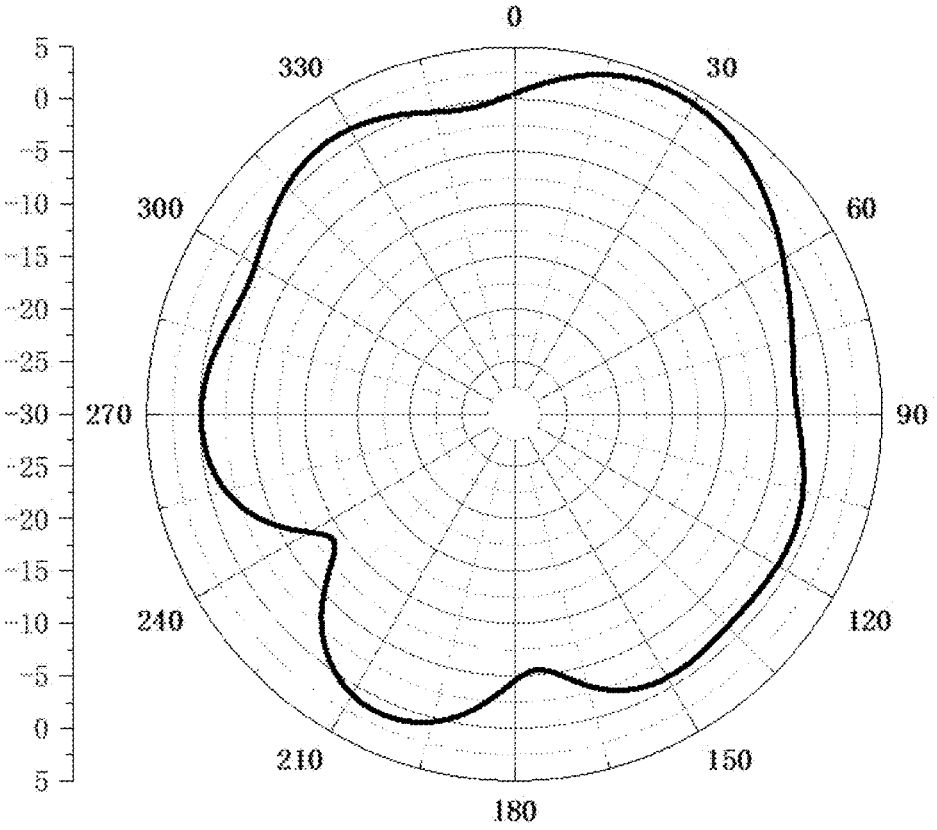
FIG. 9 is a schematic diagram of a miniaturized printed ultra wideband and Bluetooth antenna in the E-plane radiation direction at the 10.5 GHz frequency point according to an embodiment of the present invention.
Figure 10:
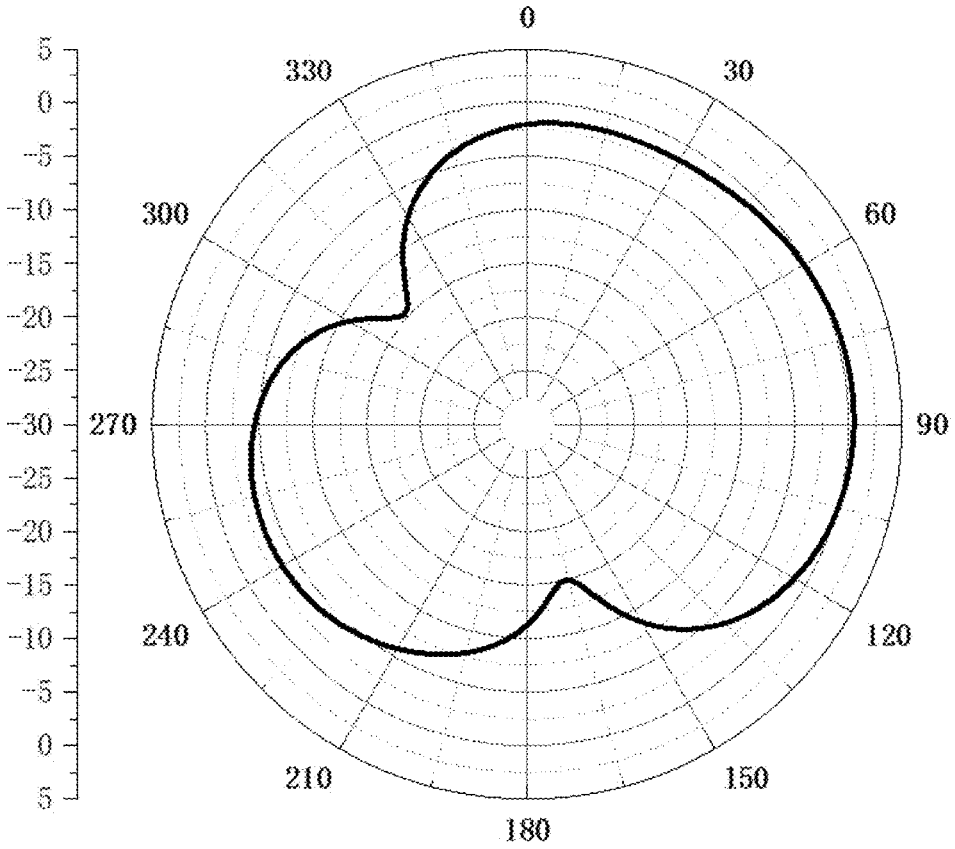
FIG. 10 is a schematic diagram of a miniaturized printed ultra wideband and Bluetooth antenna in the H-plane radiation direction at the 10.5 GHz frequency point according to an embodiment of the present invention.

FIGS. 5 and 6 are schematic diagrams of a miniaturized printed ultra wideband and Bluetooth antenna in the E-plane and H-plane radiation directions at the 3.5 GHz frequency point according to an embodiment of the present invention, respectively; FIGS. 7 and 8 are schematic diagrams of a miniaturized printed ultra wideband and Bluetooth antenna in the E-plane and H-plane radiation directions at the 7.0 GHz frequency point according to an embodiment of the present invention, respectively; and FIGS. 9 and 10 are schematic diagrams of a miniaturized printed ultra wideband and Bluetooth antenna in the E-plane and H-plane radiation directions at the 10.5 GHz frequency point according to an embodiment of the present invention, respectively. It can be seen from the radiation pattern of 3.5 GHz, 7 GHz and 10.5 GHz frequency points in the ultra wideband frequency band that the miniaturized printed ultra wideband and Bluetooth antenna has relatively consistent radiation characteristics over a very wide frequency band.

In summary, a miniaturized printed ultra wideband and Bluetooth antenna of an embodiment of the present invention comprises a first antenna element and a second antenna element, wherein the first antenna element has a rectangular shape with rounded and smoothed corners; the right side of the first antenna element comprises a first antenna body, and a rectangular notch is etched from the left side of the first antenna element; the left side of the second antenna element comprises a second antenna body, and the right side of the second antenna element has a plurality of bent portions arranged inside of the rectangular notch of the first antenna element. Since the plurality of bent portions of the second antenna element can be arranged inside of the rectangular notch of the first antenna element, the area of the antenna is greatly reduced, and the process design requirements for miniaturization of today's mobile terminals can still be met by covering both ultra wideband and Bluetooth wireless standard frequency bands.

Furthermore, the first antenna element has a rectangular shape with rounded and smoothed corners after asymmetrical miniaturization from a symmetrical circular or square radiating patch; and the rectangular notch is etched on the left side of the first antenna element; the structure is simple, and it is easy to implement the the process; and it is easy to be integrated with a circuit.

Further, the metal ground is arranged on the back side of the dielectric substrate; the metal ground is in the shape of a right-angled trapezoid; the printed monopole antenna plate is arranged on the front side of the dielectric substrate; and the metal ground and the printed monopole antenna are respectively arranged on the back side and the front side of the dielectric substrate, thereby better realizing an ultra wideband characteristic.

Further, the metal microstrip feed is arranged on the back side of the dielectric substrate, and the microstrip feeder is tapered from bottom to top to achieve impedance matching of the bottom and top antenna radiating patches of the microstrip feeder.

Further, the lower right-side end of the first antenna body is rounded and smoothed, thereby optimizing impedance matching and relaxing tolerances of antenna processing.

Further, the miniaturized printed ultra wideband and Bluetooth antenna of embodiments of the present invention has a width of only 1.75 cm and a printed planar area of only 5.75 $cm^2$, with a compact structure. After performance tests, it has been shown to operate at the 2.33-2.54 GHz and 3.09-11 GHz bands and may cover both Bluetooth (2.4-5.485 GHz) and ultra wideband (3.1-10.6 GHz) communication bands.

Finally, it should be noted that each embodiment above are only intended to illustrate the technical solution of the invention, but not to limit it. Although the invention has been described in detail with reference to the each foregoing embodiment, those skilled in the art will appreciate that the technical solutions of the each above-mentioned embodiment can still be modified, or some of the technical features thereof can be equivalently substituted; and such modifications and substitutions will not cause the essence of the corresponding technical solutions to depart from the scope of the embodiments of the invention.

The invention claimed is:

1. A miniaturized printed ultra-wideband and Bluetooth antenna comprising a dielectric substrate, a printed monopole antenna plate, a metal ground and a metal microstrip feed, wherein the printed monopole antenna plate is arranged on a front side of the dielectric substrate, characterized in that the printed monopole antenna plate comprises a first antenna element configured to operate in an ultra wideband communication band and a second antenna element configured to operate in a Bluetooth communication band, the first antenna element and the second antenna element sharing the metal ground and the metal microstrip feed;

the first antenna element has a rectangular shape with rounded and smoothed corners; the right side of the first antenna element comprises a first antenna body, and a rectangular notch is etched from the left side of the first antenna element; the left side of the second antenna element comprises a second antenna body, and the right side of the second antenna element has a plurality of bent portions arranged inside of the rectangular notch of the first antenna element; and the sum of the lengths of the plurality of bent portions is 0.2-0.4 times the wavelength of the center frequency of Bluetooth standard;

the plurality of bent portions comprise a first bent subsection, a second bent subsection, a third bent subsection and a fourth bent subsection connected end to end, wherein the first bent subsection and the fourth bent subsection are parallel to each other and distributed transversely; the second bent subsection and the third bent subsection are parallel to each other and longitudinally distributed; and the first bent subsection is longer than the fourth bent subsection, and the second bent subsection is longer than the third bent subsection.

2. The miniaturized printed ultra-wideband and Bluetooth antenna according to claim 1, characterized in that the first bent subsection has a length of 6.25 mm and a width of 1.4 mm; the second bent subsection has a length of 14 mm and a width of 1.4 mm; the third bent subsection has a length of 12 mm and a width of 1.4 mm; and the fourth bent subsection has a length of 4 mm and a width of 1.4 mm.

3. The miniaturized printed ultra-wideband and Bluetooth antenna according to claim 1, characterized in that the printed monopole antenna plate has a rectangular shape with rounded and smoothed corners after asymmetrical miniaturization from a symmetrical circular or square radiating patch; and the rectangular notch is etched on the left side of the first antenna element.

4. The miniaturized printed ultra-wideband and Bluetooth antenna according to claim 1, characterized in that the metal ground is arranged on the back side of the dielectric substrate; the metal ground is in the shape of a right-angled trapezoid; the width of the metal ground is 0.1-0.3 times a longest operating wavelength; the height of the metal ground is 0.1-1 times the width of the metal ground; and the sum of the height of the metal ground and the height of the first antenna element is 0.4-0.6 times the longest operating wavelength;

the top width of the metal ground is 0.2-0.8 times the bottom width of the metal ground; and the projected distance of the printed monopole antenna plate from the metal ground is 0.04-0.2 times the bottom width of the metal ground.

5. The miniaturized printed ultra-wideband and Bluetooth antenna according to claim 1, characterized in that the metal microstrip feed is arranged on the back side of the dielectric substrate, the metal microstrip feed being tapered from bottom to top to achieve impedance transformation.

6. The miniaturized printed ultra-wideband and Bluetooth antenna according to claim 1, characterized in that a first gap is formed between the second bent subsection and the third bent subsection, the first gap having a width of 1.2 mm; a second gap is formed between the third bent subsection and the second antenna body, the second gap having a width of 1 mm; a third gap is formed between the first bent subsection and the fourth bent subsection, the third gap having a width of 11.2 mm; and a fourth gap is formed between the fourth bent subsection and the first antenna body, the fourth gap having a width of 1.5 mm.

7. The miniaturized printed ultra-wideband and Bluetooth antenna according to claim 1, characterized in that a first end of the first antenna element is electrically connected to a feeding end of the metal microstrip feed, and a second end of the first antenna element is a free end suitable for radiating a signal; and a first end of the second antenna element is electrically connected to a feeding end of the metal microstrip feed, and a second end of the second antenna element is a free end suitable for radiating a signal.

8. The miniaturized printed ultra-wideband and Bluetooth antenna according to claim 1, characterized in that right upper and lower ends of the printed monopole antenna plate are rounded and smoothed respectively.

9. The miniaturized printed ultra-wideband and Bluetooth antenna according to claim 1, characterized in that the dielectric substrate has a dielectric constant of 2-10, a loss tangent of $10^{-3}$ or less, and a thickness of 3 mm or less.

* * * * *